US008256351B1

(12) United States Patent
Kramer et al.

(10) Patent No.: US 8,256,351 B1
(45) Date of Patent: Sep. 4, 2012

(54) NON-LETHAL VARIABLE DISTANCE ELECTRONIC TIMED PAYLOAD PROJECTILE AMMUNITIONS

(75) Inventors: Michael Kramer, Casper, WY (US); Corey Rutz, Casper, WY (US)

(73) Assignee: Safariland, LLC, Jacksonville, FL (US)

( * ) Notice: Subject to any disclaimer, the term of this patent is extended or adjusted under 35 U.S.C. 154(b) by 364 days.

(21) Appl. No.: 12/583,283

(22) Filed: Aug. 17, 2009

Related U.S. Application Data

(60) Provisional application No. 61/190,603, filed on Aug. 29, 2008.

(51) Int. Cl.
*F42B 30/00* (2006.01)
*F42B 12/46* (2006.01)

(52) U.S. Cl. ..... 102/502; 102/512; 102/513; 102/370; 102/215; 102/218

(58) Field of Classification Search ..... 102/206, 102/215, 218, 262, 264, 501, 502, 512, 513, 102/439, 444, 498, 529, 370
See application file for complete search history.

(56) References Cited

U.S. PATENT DOCUMENTS

| | | | | |
|---|---|---|---|---|
| 4,379,531 | A | 4/1983 | Manis | |
| 5,962,806 | A | 10/1999 | Coakley et al. | |
| 6,374,741 | B1 | 4/2002 | Stanley et al. | |
| 6,405,744 | B1 | 6/2002 | LaPant | |
| 6,857,369 | B2 * | 2/2005 | Bossarto et al. | 102/342 |

OTHER PUBLICATIONS

International Search Report and Written Opinion for International Application No. PCT/US09/54068, mailed Apr. 28, 2010, 8 pages.

* cited by examiner

*Primary Examiner* — James Bergin
(74) *Attorney, Agent, or Firm* — Kane Kessler, P.C.; Paul E. Szabo

(57) ABSTRACT

A non-lethal projectile used to immobilize, impair, disorient, or distract a live target. The non-lethal projectile can also be used as a signaling device. In one embodiment, a non-lethal payload carrying projectile that is detonated at a set distance determined and, set by the operator. The distance is electronically controlled and can be set in the field seconds before the projectile is fired.

20 Claims, 10 Drawing Sheets
(6 of 10 Drawing Sheet(s) Filed in Color)

230
290
230a
230b
230c
260
A
A
SECTION A-A
SCALE 1 : 1

CONDUCTIVE SHELL

PROJECTILE BODY BASE

PROJECTILE BODY MID-SECTION

PROJECTILE BODY NOSE

BLANK LOAD

NON-LETHAL VARIABLE DISTANCE ELECTRONIC TIMED PAYLOAD PROJECTILE AMMUNITIONS

CROSS-REFERENCE TO RELATED APPLICATIONS

This application claims priority to and the benefit of U.S. Provisional Application No. 61/190,603, filed on Aug. 29, 2008, the entire content of which is incorporated herein by reference.

FIELD OF THE INVENTION

The present invention relates generally to the field of non-lethal projectile ammunitions used to immobilize, impair, disorient, and/or distract live targets. These non-lethal projectile ammunitions can also be used as signaling devices.

BACKGROUND OF THE INVENTION

Non-lethal projectile bodies are often shot at or near human targets at high velocities and at long and varying distances. It is imperative that the detonation or dispersion of the payload of the projectile body be near the target. The detonation distance is controlled and determined by the time at which the payload is activated as well as the travel velocity of the non-lethal projectile body. The current mechanical fuse projectile bodies used to date can be unpredictable and have varying distance result. This variation is in part caused by mechanically pressed fuses or chemical material burn fuses that are dependent on burn rate consistency. The material burn and mechanical pressed fuses are also hard set to detonate at a preset time that is built into the ammunition and is not adjustable. The accuracy of the detonation point is critical to maximize or increase the ammunitions' intended function of affecting the target.

Non-lethal targets are often individual crowds of humans, small groups within a crowd, or individuals alone or within a crowd. The nature of these groups is to move around thus presenting the shooter with variable distances that the projectile body should be deployed at to be effective. A non-lethal variable distance electronic payload projectile body allows the user to target a specific group or individual with maximum or high effectiveness. The non-lethal projectile payload can be chemical smoke irritants, chemical powder irritants, signal smoke, signal powder, flash powder, liquid chemical irritants, inert chemicals, marking powder, ultra violet (UV) or infrared (IR) marking powder or liquid, an array of led for lighting, or combinations thereof.

In view of the foregoing, it would be highly desirable to provide a non-lethal projectile body capable of allowing its user to accurately deliver the payload of the projectile body to a preset or predetermined desired distance at a set or predetermined time (e.g., seconds) before the projectile ammunition including the projectile body is fired. Further, it would be desirable to allow such user to be able to engage individual targets or groups at various distances via the use of the non-lethal variable distance electronic timed payload projectile ammunition.

SUMMARY OF THE INVENTION

An aspect of an embodiment of the present invention is directed toward a non-lethal variable distance electronic timed payload projectile ammunition that is detonated at a set distance determined and set by the operator. In one embodiment of the present invention, the distance is electronically controlled and can be set in the field seconds before the projectile ammunition including the projectile body is fired.

An embodiment of the present invention provides a non-lethal variable distance electronic timed payload projectile ammunition. The non-lethal variable distance electronic timed payload projectile ammunition is designed to detonate or activate a payload at a distance that is pre-set by the operator before the ammunition is loaded into a launcher. The operator arms the non-lethal payload projectile ammunition and sets the travel distance of the projectile body of the ammunition with a switch. After the projectile ammunition is armed and set for the correct distance the user loads the projectile ammunition into the launcher. When the ammunition is fired, a connection will be activated starting the timing process. An explosion or blast will propel the projectile body out of the launcher. The timing that was preset by the operator starts to countdown after the non-lethal projectile ammunition is fired. Once the pre-determined set time is reached, an electronic match or squib circuit (or squib) activates the payload. The electronics in the circuit will detonate or dissipate the payload at the intended distance allowing for maximum or increased non-lethal effectiveness to the intended target.

An embodiment of the present invention provides a non-lethal variable distance electronic timed payload projectile ammunition (or non-lethal electronic aerial payload projectile ammunition) composed of a switch; a printed circuit board (PCB); a conductive shell; a projectile body to carry a non-lethal payload; a battery; an electronic igniter; and a timing circuit (see e.g., FIG. 1 or 2). Here, in one embodiment, the switch; the printed circuit board; the battery; the non-lethal payload; the electronic igniter; and the timing circuit are coupled with each other within the projective body that is attached to the conductive shell. The timing circuit can be, e.g., the timing or delay circuit shown in FIG. 1 or 2.

Another embodiment of the present invention provides a non-lethal variable distance electronic timed payload projectile ammunition including a shell (e.g., a conductive shell), a non-lethal payload, a projectile body, a printed circuit board, an electronic igniter, a timing circuit, a switch, and a battery. Here, the projectile body is coupled to the conductive shell and for carrying the non-lethal payload. The printed circuit board is in the projectile body. The electronic igniter is for initiating the non-lethal payload. The timing circuit is on the printed circuit board and for electronically delaying ignition of the electronic igniter. The switch is for switching the timing circuit in and out of a dormant state and for varying ignition delay of the timing circuit to ignite the electronic igniter, and the battery is for providing a first power to the timing circuit and a second power to the electronic igniter.

In one embodiment, the battery includes a first battery for providing the first power to the timing circuit, and a second battery separate from the first battery and for providing the second power to the electronic igniter.

In one embodiment, the battery includes a first battery for providing the first power to the timing circuit, and a power capacitor separate from the first battery and for providing the second power to the electronic igniter.

In one embodiment, the timing circuit includes a microprocessor that is configured by the switch to select a projectile travel distance from a plurality of selectable projectile travel distances, the projectile body travel distance being controlled by the timing circuit and a velocity at which the projectile body is traveling.

In one embodiment, the non-lethal variable distance electronic timed payload projectile ammunition further includes a light emitting diode (LED) on the circuit board and for indicating that the timing circuit is out of the dormant state.

In one embodiment, the non-lethal variable distance electronic timed payload projectile ammunition further includes a display on the circuit board and for indicating a state of the timing circuit.

In one embodiment, the timing circuit is an RC timing circuit, Schmidt trigger, or 555 timing circuit.

In one embodiment, the non-lethal payload includes a chemical payload. Here, the chemical payload may be selected from the group consisting of chemical irritant powder payloads, chemical irritant liquid payloads, chemical marking powder payloads, chemical marking liquid payloads, chemical powder distraction payloads for producing between about 0 decibel (db) and about 300 decibel (db) when detonated, chemical powder flash payloads for producing flashes when detonated, ultra violet (UV) chemical powder payloads, UV chemical liquid payloads, infrared (IR) chemical liquid payloads, IR chemical powder payloads, and combinations thereof.

In one embodiment, the non-lethal variable distance electronic timed payload projectile ammunition further includes a shunt connector connected to an electrical contact in the conductive shell to block the timing circuit from its timing operation.

In one embodiment, the non-lethal variable distance electronic timed payload projectile ammunition further includes the projectile body with a boat tail for reducing base drag.

In one embodiment, the projectile body has a driving band to engage rifling of a launcher barrel to spin the projectile body for flight stability.

In one embodiment, the conductive shell includes a blank cartridge containing powder, and the blank cartridge is configured to ignite the powder in the blank cartridge when struck by a firing hammer of a launcher to separate the projectile body from the conductive shell and to send the projectile body out of the launcher.

In one embodiment, the non-lethal variable distance electronic timed payload projectile ammunition further includes a potting filled at least partially around the timing circuit and on the printed circuit board to protect the timing circuit and the printed circuit board.

In one embodiment, the electronic igniter is configured to be shunted until the ammunition has been fired.

In one embodiment, the electronic igniter is configured to be grounded to the conductive shell to shunt and protect the electronic igniter from being ignited until the projectile body is separated from the conductive shell even if power is provided to the electronic igniter.

In one embodiment, the electronic igniter is configured to be grounded to the conductive shell to shunt and protect the electronic igniter from a radiated power capable of igniting the electronic igniter and to pass the radiated power to ground.

Another embodiment of the present invention provides a non-lethal variable distance electronic timed payload projectile ammunition including a conductive shell, a non-lethal payload, a projectile body, an electronic igniter, a timing circuit, a switch, a primary power source, and a secondary power source. Here, the projectile body is for carrying the non-lethal payload and configured to be physically coupled to the conductive shell until the ammunition is fired. The electronic igniter is configured to be electrically grounded to the conductive shell until the projectile body is separated from the conductive shell and for initiating the non-lethal payload. The timing circuit is configured to be electrically grounded to the conductive shell via a second ground until the projectile body is separated from the conductive shell and utilized for electronically delaying ignition of the electronic igniter. The switch is for switching the timing circuit in and out of a dormant state and for varying ignition delay of the timing circuit to ignite the electronic igniter. The primary power source is for providing a first power to the timing circuit to operate the timing circuit, and the secondary power source is for providing a second power to the electronic igniter to ignite the electronic igniter.

Another embodiment of the present invention provides a method for varying an initiation time for a non-lethal variable distance electronic timed payload projectile ammunition. The method includes: grounding a projectile body for carrying a non-lethal payload to a conductive shell; switching a timing circuit out of a dormant state; selecting an ignition delay period of the timing circuit from a plurality of selectable delay periods; separating the projectile body from the conductive shell by firing the ammunition; allowing the timing circuit to begin timing out the selected ignition delay period; and allowing enough current to pass to an electronic igniter to initiate the non-lethal payload once the end of the selected ignition delay period has been reached.

In one embodiment, the projectile body has to be separated from the conductive shell before the time circuit can start timing and also before the electronic igniter can be ignited to initiate the non-lethal payload body.

In one embodiment, the grounding of the projectile body to the conductive shell comprises grounding the electronic igniter to the conductive shell, and the electronic igniter can not be ignited to initiate the non-lethal payload body until the grounding of the electronic igniter to the conductive shell has been severed.

In one embodiment, the allowing of the timing circuit to begin timing out the selected ignition delay period includes severing the grounding of the projectile body from the conductive shell.

In one embodiment, the allowing of enough current to pass to the electronic igniter to initiate the non-lethal payload once the end of the selected ignition delay period has been reached includes severing the grounding of the projectile body from the conductive shell.

In one embodiment, the allowing of the timing circuit to begin timing out the selected ignition delay period includes providing a first power to the timing circuit to operate the timing circuit via a first battery, and the allowing of enough current to pass to the electronic igniter to initiate the non-lethal payload once the end of the selected ignition delay period has been reached includes providing a second power to provide enough current to the electronic igniter to initiate the non-lethal payload via a secondary power source.

A more complete understanding of the non-lethal variable distance electronic timed payload projectile will be afforded to those skilled in the art and by a consideration of the following detailed description. Reference will be made to the appended sheets of drawings which will first be described briefly.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The accompanying drawings, together with the specification, illustrate exemplary embodiments of the present invention, and, together with the description, serve to explain the principles of the present invention.

DETAILED DESCRIPTION OF THE EMBODIMENTS

Figure 1:
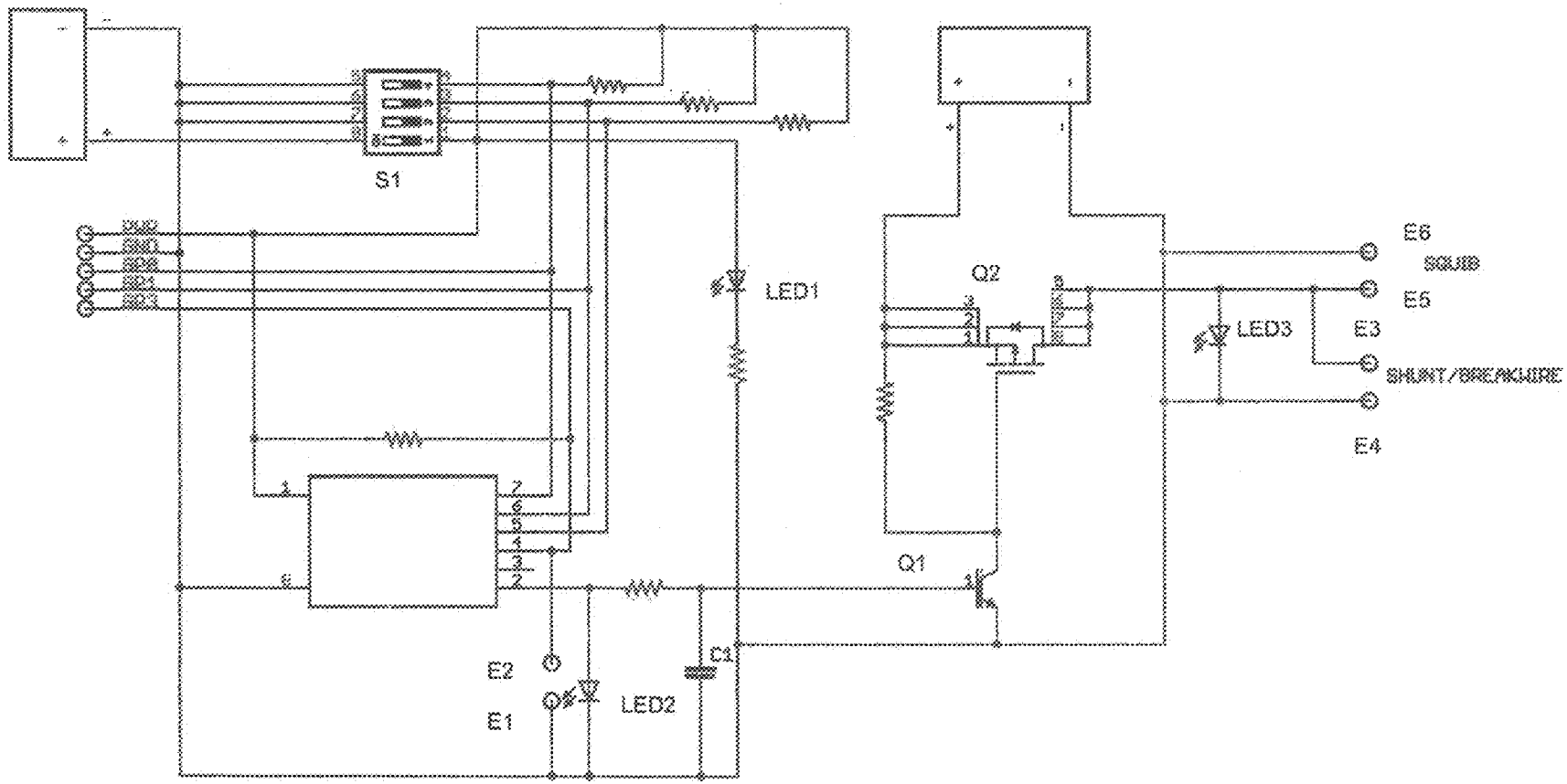
FIG. 1 is a circuit schematic of a microprocessor and a squib power timing circuit that utilize different batteries pursuant to an embodiment of the present invention.

In the following detailed description, only certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, and not restrictive. Like reference numerals designate like elements.

An embodiment of the present invention provides a non-lethal variable distance electronic timed payload ignition projectile ammunition that includes a timing circuit on a printed circuit board. The circuit's purpose is to allow for an adjustable time delay. The delay is the time between the firing of the non-lethal variable distance electronic timed payload projectile ammunition composed of a projectile body containing this timing circuit and the time of activation of the charge contained in the projectile body. The main components of the circuit are batteries, switches, and a microprocessor.

Here, in one embodiment, a user input interface is provided in the circuit to allow adjustment of the time delay. This is accomplished by the use of a switch interface in one embodiment of the present invention. This interface could be slide switches, push button switches, variable resistance switches, etc. In one embodiment, a visual indication of how much delay time has been chosen is also provided. Slide or toggle switches' positions can be utilized for this purpose as well as a rotary variable resistance switch. In the case of push button switches, a visual indication is added in one embodiment thru the use of light, vibration, or audible sound. These switches connect to the microprocessor.

In operation, the circuit's microprocessor is the brain of the circuit. It takes input from the user interface to adjust the delay time that it is counting. It also takes input from other parts of the circuit to know when the projectile ammunition has been fired. It then also controls activation of the igniter part of the circuit that activates the charge in the projectile body. Microprocessors require power which more than likely will come from an internal battery of the projectile body. Most projectile bodies are not foreseen to need replaceable batteries once assembled with the charge. For this reason, it is important to manage the power of the microprocessor. This can be accomplished by using a low power microprocessor adapted for battery applications, by placing the microprocessor into sleep mode which will greatly reduce its power consumption, or even by allowing the microprocessor to turn off its own power. By using the above described mechanisms, it allows for the shelf life of the projectile ammunition to approach the battery's own shelf life.

In one embodiment of the present invention, the igniter portion of the circuit also uses battery power. Most electronically fired squibs require a high current for a period of time to heat up and ignite. This high amount of current becomes difficult to obtain out of the small batteries that fit into small projectiles due to the internal resistance of the batteries. More circuitry can be added to allow the use of a capacitive charging circuit. These types of circuits charge a storage capacitor using a lower battery current and then can discharge with a higher voltage and current capable of igniting a squib. There are concerns that arise using those types of circuits such as charging time or the capability of safely discharging the capacitor in case of a no fire situation.

As envisioned in one embodiment of the present invention, use of a small battery that will ignite the squib may not provide appropriate power to any other circuitry in the projectile. The battery is capable of producing the high current required to ignite the squib, but in doing so, the voltage of the battery drops to a brown out condition. This result may be that the voltage is so low any remaining circuitry cannot function. This can affect the circuitry that is actually controlling the power to the squib creating an uncertainty of igniting the squib. The choice of battery power versus size becomes important when trying to produce a small projectile.

As mentioned above, a mechanism for knowing when the projectile ammunition has been fired is utilized to allow the delay timing to start. This mechanism can be composed of additional switches or even additional circuitries. Non-limiting examples of the additional switches or circuitries include a circuitry that can sense a velocity or acceleration related to the firing of a projectile body out of a launcher or circuitry that is barrel mounted and, as the projectile body passes it during its launch out of the barrel, it activates the circuitry in the projectile body.

Also, depending on the mechanical make-up of the ammunition, a switch can be made utilizing the projectile's conductive shell or metal shell. Contacting probes from the circuit board can connect with the metal shell. When the projectile ammunition is fired, the projectile body is separated from the metal shell and the contacts lose connectivity to each other due to the loss of the connecting metal shell. These contacts can be compression pins that use axial compression along the length of the projectile body or compression strips that use radial compression between the projectile body and the metal shell.

Another embodiment for this switch uses so called break wires. These wires are thin wires that connect to the circuit board on both ends but loop through the pressure cavity between the projectile body and metal shell. The explosion of the blank causes the wires to break/melt open and cut the electrical connection acting just like a switch.

As such by taking the above discussion into consideration, and, e.g., a desire to waterproof the projectile ammunition, and a driving factor of shell size, the timing circuit of an embodiment of the present invention is described below in more detail with reference to FIGS. 1 and 2.

FIG. 1 is a circuit schematic of a microprocessor and a squib power timing circuit that utilize different batteries pursuant to an embodiment of the present invention.

Here, as shown in FIG. 1, the circuit utilizes a microprocessor to take input from a switch that signals a non-lethal variable distance electronic timed payload projectile ammunition that has been fired from a launcher. Upon receiving this input, the microprocessor then reads a time value from the user input device and starts a timer. Once this timer has elapsed, the microprocessor then activates an output pin to enable power to an electronic igniter, squib, or electric match.

The microprocessor output has an RC circuit connected to it for safety purposes to de-glitch the output before it goes to the squib power circuit.

The squib power circuit (or squib) is composed of a P-fet switch that connects the positive battery terminal to the squib. The other side of the squib is connected directly to the battery ground.

In one embodiment of the present invention as shown in FIG. 1, the microprocessor and squib run off of different batteries. This allows small batteries to be used with no step-up capacitor discharge circuits being used also. To keep the battery size down, the battery is so small that if one battery was used, when the squib tries to fire it causes a brown out condition that would reset the microprocessor. This creates a possible no-fire condition for the squib. The circuit in FIG. 1 draws no power from the battery until the unit is switched on. This provides the same shelf life for the round as does the battery. In addition, this circuit has a switch that grounds the power side of the squib. This provides safety in case power is applied to the squib before the round is shot.

In more detail and as shown in FIG. 1, S1 is a slide button switch that controls power to the microprocessor and allows setting of seven (7) different delay timings. By using this switch, the battery for the microprocessor is not being used during storage and therefore allows as much shelf life as the battery manufacturer allows.

Once position 1 of S1 is slid on, the microprocessor will boot and read positions 2-4 of S1 to determine the set delay time. This delay time will not be activated until the breakwire across E1 and E2 is severed by the explosion. Once the microprocessor sees this input go high, since the breakwire holds the input to ground until severed, it will assert the output to drive Q1 on. This will in turn drive the gate of the PFET Q2 to ground and enable the second battery to be switched on to the squib across E5 and E6.

The gate of Q2 is normally pulled high using a high value resistor to limit the current draw and save battery life. Q2 once switched on, effectively shorts the battery across the squib allowing for a high current surge needed by the squib to go off. This also allows for the use of a smaller battery with a smaller output current rating.

LED 1 shows the user that power has been applied to the microprocessor side of the circuit and will always be in the design.

LED2 shows when the microprocessor turns on the output to drive the R5 and C1 low pass filter that drives Q1's base. It can be removed during a final production stage.

LED3 shows when power has switched on by Q2 to E5 of the squib connection point. It can be removed during a final production stage also.

The combination of LED2 and LED3 allows for visual measuring of the low pass filter delay.

The shunt wire across E3 and E4 is a safety protocol. Even if power is applied to the squib and wire has not been severed, the squib is shorted and will not blow. This wire shows that the shell has been fired and allows for detonation of the squib.

Figure 2:
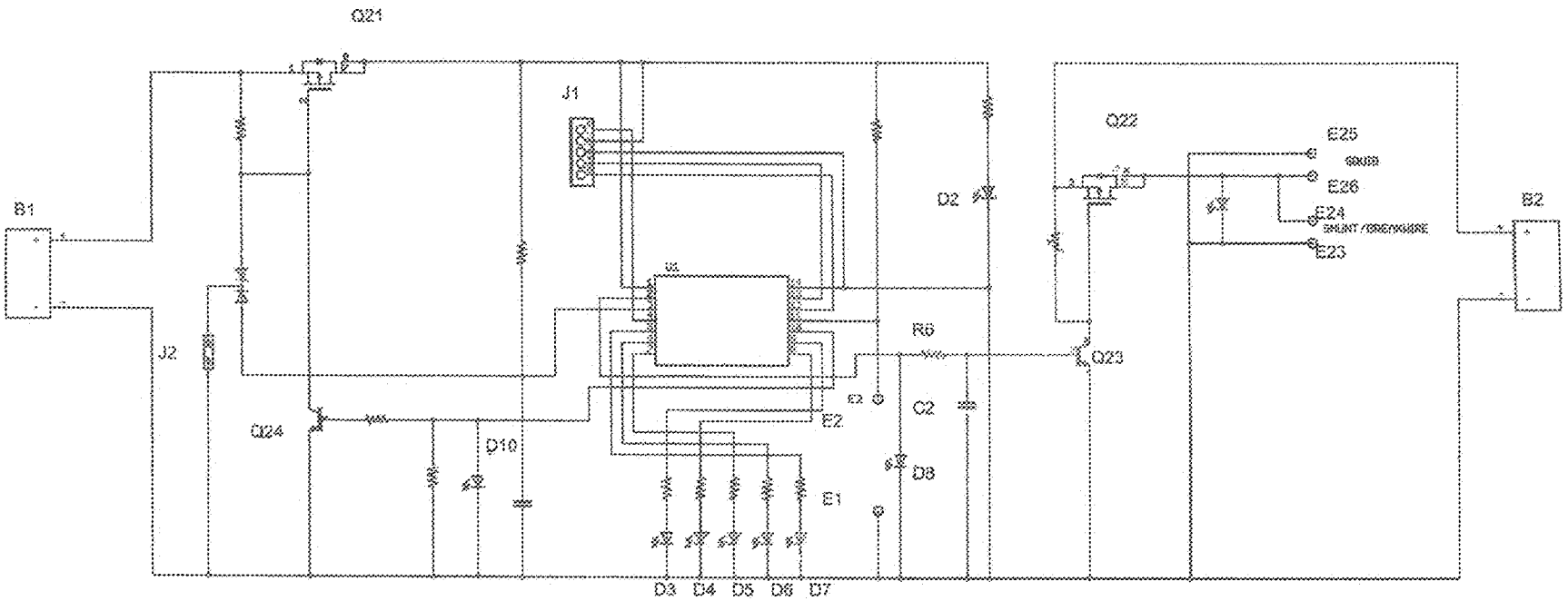
FIG. 2 is a circuit schematic of a microprocessor and a squib power timing circuit that utilize different batteries pursuant to another embodiment of the present invention.

FIG. 2 is a circuit schematic of a microprocessor and a squib power timing circuit that utilize different batteries pursuant to another embodiment of the present invention.

For waterproofing purposes, the user interface utilizes a one (1) membrane push button switch J2 (in FIG. 2) with visual LED indication. LEDs D2, D3, D4, D5, D6, and D7 are used to show microprocessor power and five (5) delay settings. The single push button switch initially turns on a FET switch Q21 that supplies power to the microprocessor. This allows the microprocessor to initiate/boot and then take over control of the FET switch Q21 using transistor Q24. If it did not do this, as soon as the puss button switch J2 was released, the FET switch Q21 would turn off power to the microprocessor.

The microprocessor was adapted to control its own power for this design for several reasons. The first reason is safety. With the microprocessor off, there are no safety concerns with the microprocessor's code going into undefined action and activating the squib in error. Second, keeping the microprocessor off reserves more battery power than putting it into sleep mode since it will not be using any power at all. At any point in the control software, the microprocessor can release the FET control signal and turn itself off. Currently this only happens after cycling through the "ON" press and then the 5 delay presses. The next press will make the microprocessor turn itself off.

With the user interface, the user can turn on the microprocessor in the projectile body and then set 1 of 5 delay settings. The microprocessor will then wait until the switch from E21 to E22 is opened and start counting the delay time. At the same time E21 to E22 is opened, the switch from E23 to E24 will also be opened. This removes the safety shunt from across the squib. The shunt grounds both sides of the squib not allowing it to receive power and ignite. Once the delay time has been reached the microprocessor will assert a signal turning on transistor Q23 which turns on FET Q22 supplying power to the squib.

Power for the circuitry comes from two (2) batteries B1 and B2. Battery B1 is for the microprocessor supply, and battery B2 is for the squib supply. Battery B1 battery may be capable of igniting the squib, but the voltage may brown out and reset the microprocessor if it used the same battery with the squib. Due to battery sizes, an embodiment of the present invention utilizes 2 batteries rather than one battery that is larger than both battery B1 and battery B2 put together. This also enhances the circuit embodiment as shown because it keeps the battery for the squib at full power since it will not be used until the squib is ignited. The battery for the microprocessor can be used for indefinite periods (such as arming for a period and then being disarmed) and is also used to supply all the LED power. It therefore can lose power quicker but still have plenty to perform the necessary control functions.

LEDs D8, D9, and D10 are used for other circuit indicators and may not be installed in the final product. LED D8 shows when the microprocessor is asserting the signal to the transistor controlling the squib FET Q22. LED D9 shows when the squib power is active and the shunt removed. LED D10 shows when the microprocessor is holding its own power on.

There is also an RC delay (R6 and C2) on the output of the microprocessor to the transistor Q23 controlling the squib FET Q22. This filters out any glitches on the signal for safety purposes. Another RC delay exists with the membrane switch Q21 input to the microprocessor to slow the signal down and remove glitches.

Figure 3A:
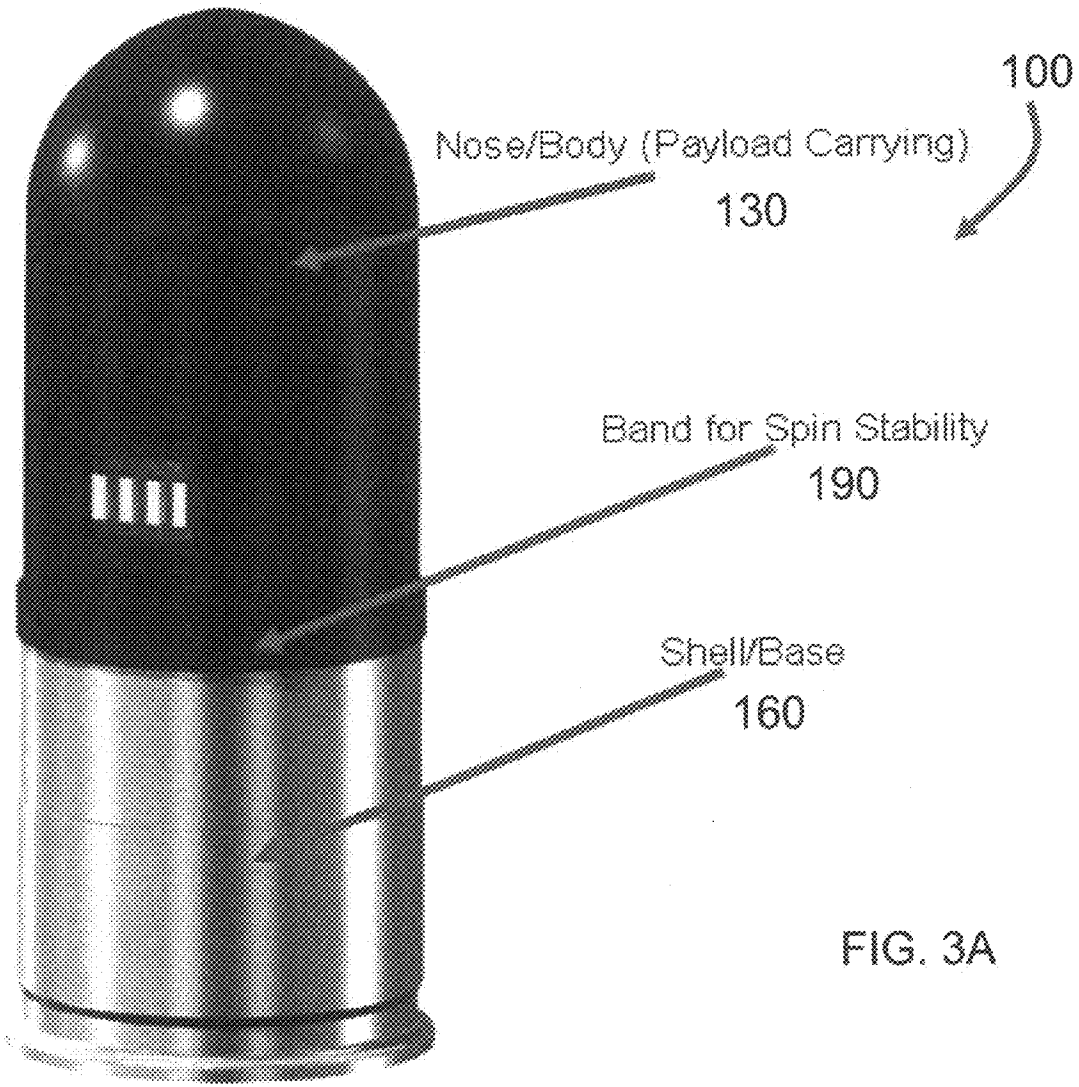
FIG. 3A is a perspective schematic of a non-lethal electronic aerial payload projectile ammunition pursuant to an embodiment of the present invention.
Figure 3B:
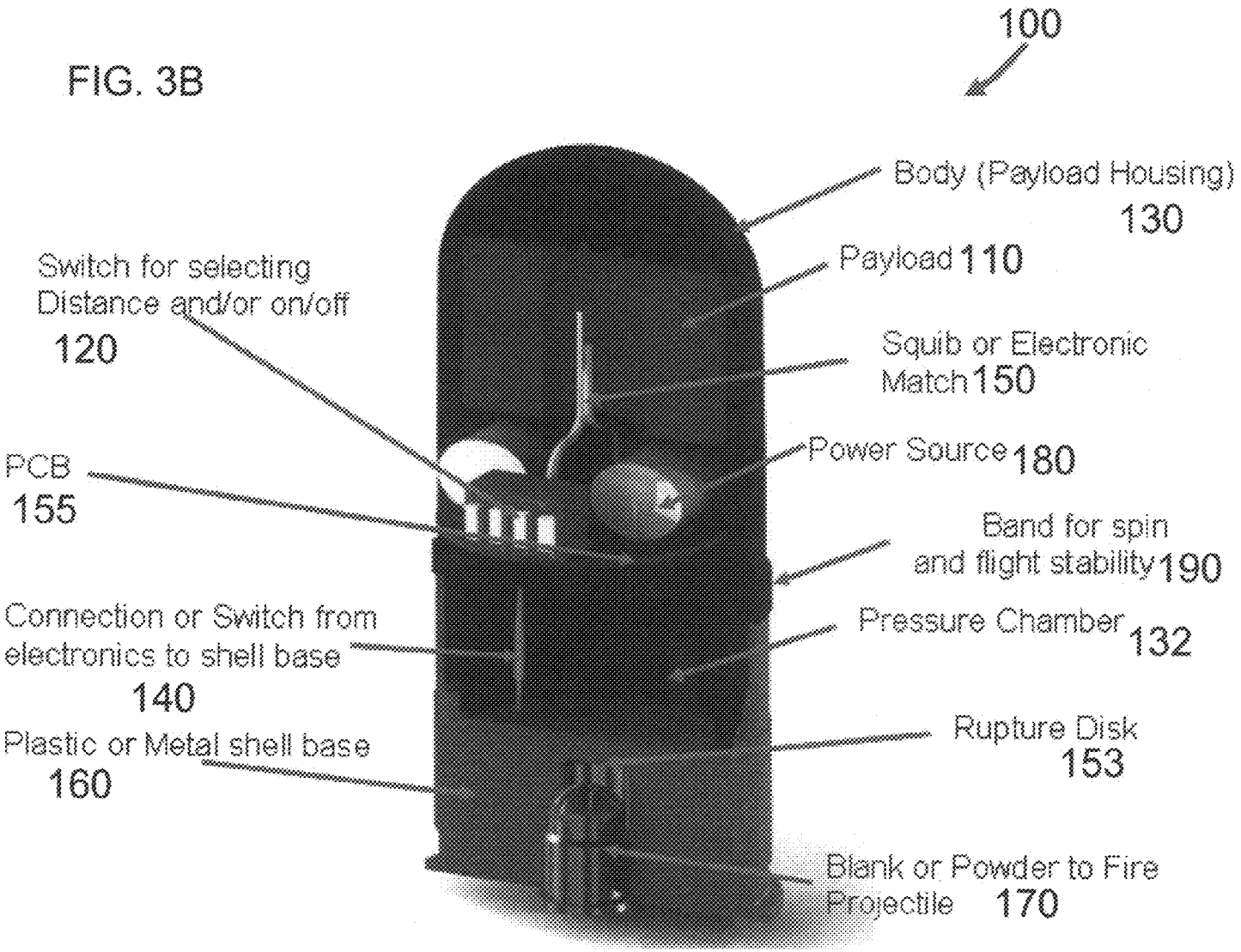
FIG. 3B is a cross-section schematic of the non-lethal electronic aerial payload projectile ammunition of FIG. 3A pursuant to an embodiment of the present invention.

FIG. 3A is a perspective schematic of a non-lethal electronic aerial payload projectile ammunition pursuant to an embodiment of the present invention, and FIG. 3B is a cross-section schematic of the non-lethal electronic aerial payload projectile ammunition of FIG. 3A pursuant to an embodiment of the present invention.

Referring to FIGS. 3A and 3B, the non-lethal electronic aerial payload projectile ammunition as shown is a non-lethal variable distance electronic timed payload ignition projectile ammunition 100 according to an embodiment of the present invention. Here, the non-lethal variable distance electronic timed payload ignition projectile ammunition 100 is designed to detonate or activate a payload 110 at a distance that is preset by the operator before the projectile ammunition 100 is loaded into a launcher. The operator arms the non-lethal projectile ammunition 100 and sets the travel distance of a projectile body 130 for housing the payload 110 with a switch 120 for selecting distance and arming and disarming the ammunition 100. After the projectile ammunition 100 is armed and set for the correct distance, the user loads the projectile ammunition 100 into the launcher. When the ammunition 100 is fired a connection 140 will be activated starting the timing process of a timing circuit (see, e.g., FIG. 1 or 2) on a printed circuit board 155 in the projectile body 130. An explosion or blast will propel the projectile body 130 out of the launcher. The timing that was preset by the operator starts to countdown after the non-lethal projectile ammunition 100 is fired. Once the pre-determined set time is reached, an electronic match or squib 150 activates the payload 130. The electronics in the timing circuit will detonate or dissipate the payload at the intended distance allowing for maximum or increase non-lethal effectiveness to the intended target.

More specifically and referring to FIG. 3B, an embodiment of the present invention provides the non-lethal variable distance electronic timed payload projectile ammunition 100. The ammunition 100 includes a conductive shell 160, the non-lethal payload 110, the projectile body 130, the printed circuit board 155, the electronic igniter 250, the timing circuit, the switch 120, and a battery 180. Here, the projectile body 130 is coupled to the conductive shell 160 and for carrying the non-lethal payload 110. The printed circuit board 155 is in the projectile body 130. The electronic igniter 150 is for initiating the non-lethal payload 110. The timing circuit is on the printed circuit board 155 and for electronically delaying ignition of the electronic igniter 150. The switch 120 is for switching the timing circuit in and out of a dormant state and for varying ignition delay of the timing circuit to ignite the electronic igniter, and the battery is for providing a first power to the timing circuit and a second power to the electronic igniter 150.

In one embodiment, the projectile body 130 has a driving band 190 to engage rifling of a launcher barrel to spin the projectile body 130 for flight stability.

As shown in FIG. 3B, the conductive shell according to an embodiment of the present invention also includes a blank cartridge (or blank load) 170 containing powder, and the blank cartridge 170 is configured to ignite the powder in the blank cartridge 170 when struck by a firing hammer of a launcher to separate the projectile body 130 from the conductive shell 160 and to send the projectile body 130 out of the launcher.

In addition and as shown in FIG. 3B, the rear of the projectile body 130 is open, and a generally hollow cavity (or pressure chamber) 32 is formed by the internal surface of the side walls of the projectile body 130 and a rupture disk 135 placed between the pressure chamber 32 and the blank cartridge 170. The projectile body 130 is typically made of a plastic, or a rigid molded polymer to provide strength without excessive weight. A more detailed description of the projectile body 130 according to an embodiment of the present invention is provided in U.S. patent application Ser. No. 12/113,460, entitled Extended Range Non-Lethal Projectile, the entire content of which is incorporated herein by reference.

Figure 4:
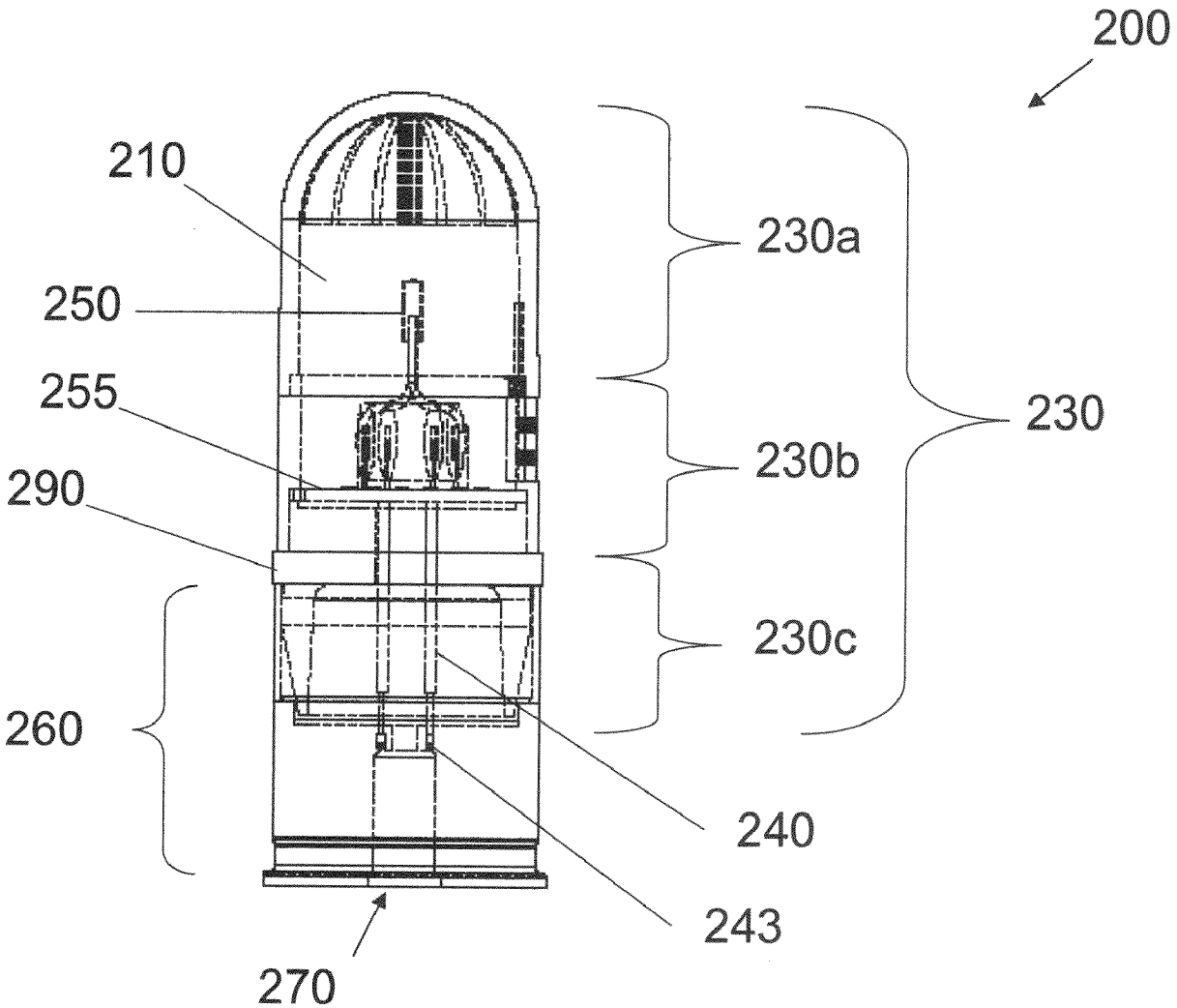
FIG. 4 is a perspective schematic of a non-lethal variable distance electronic timed payload projectile ammunition pursuant to an embodiment of the present invention.
Figures 5A, 5B:
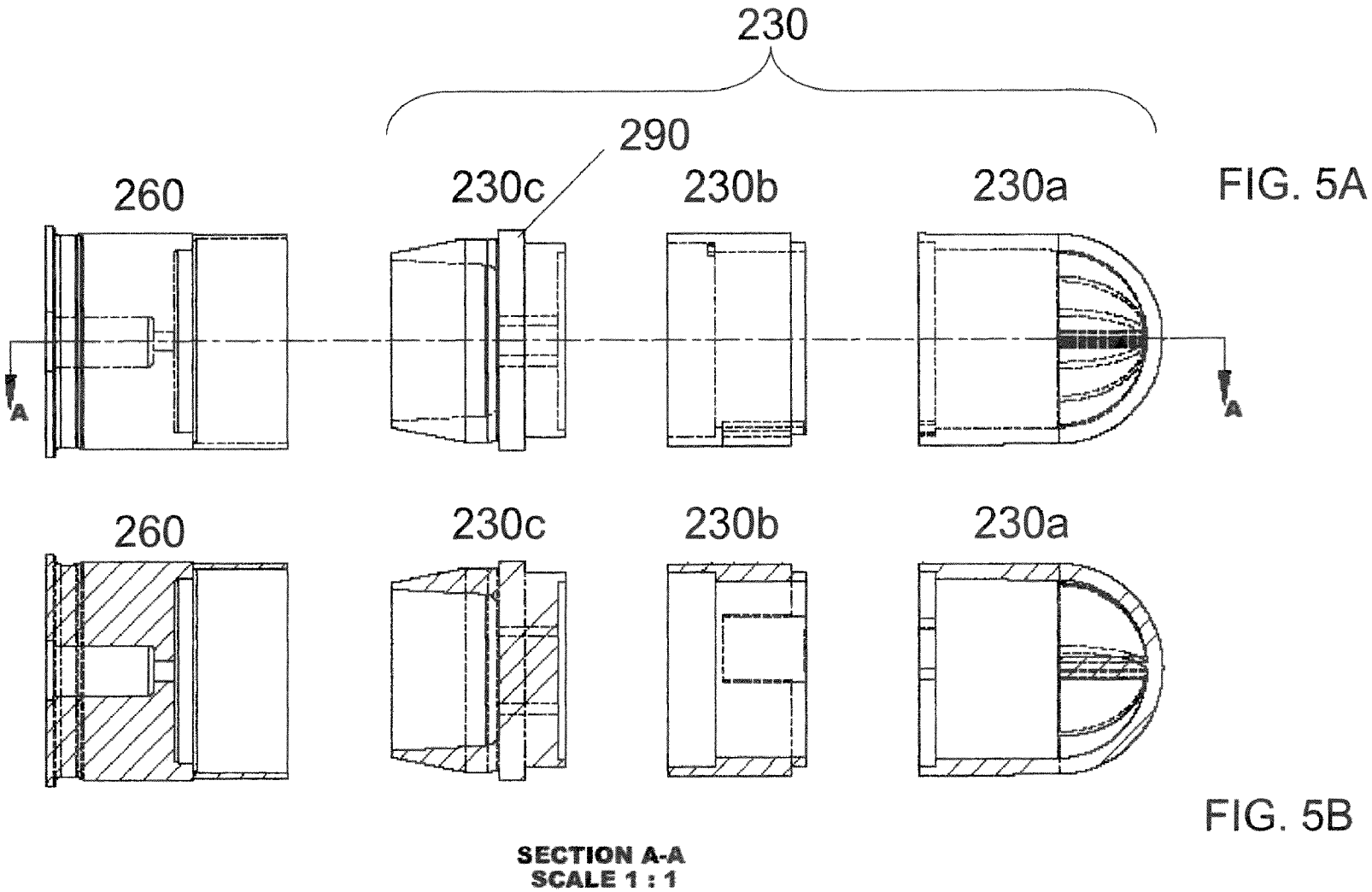
FIG. 5A is an exploded schematic of the non-lethal variable distance electronic timed payload projectile ammunition of FIG. 4 pursuant to an embodiment of the present invention.
FIG. 5B is a cross-sectional schematic of the non-lethal variable distance electronic timed payload projectile ammunition along line A-A of FIG. 5B pursuant to an embodiment of the present invention.
Figure 6A:
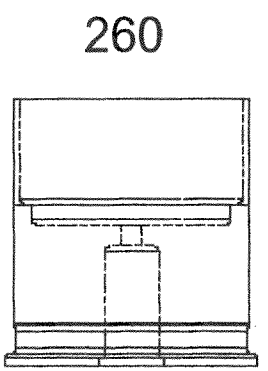
FIGS. 6A, 6B, 6C, 6D, and 6E are perspective schematics respectively showing a conductive shell, a projectile body base, a projectile body mid-section, a projectile body nose, and a blank load pursuant to embodiments of the present invention.
Figure 6B:
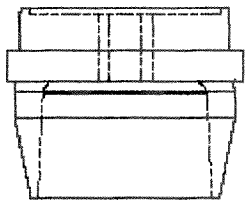
Figure 6C:
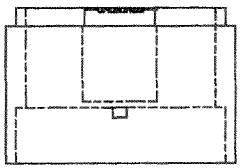
Figure 6D:
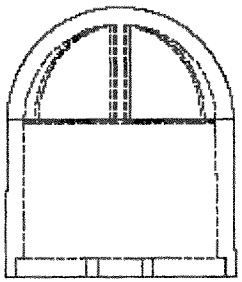
Figure 6E:
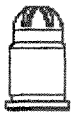

FIG. 4 is a perspective schematic of a non-lethal variable distance electronic timed payload projectile ammunition 200 pursuant to an embodiment of the present invention. FIG. 5A is an exploded schematic of the non-lethal variable distance electronic timed payload projectile ammunition 200 of FIG. 4 pursuant to an embodiment of the present invention. FIG. 5B is a cross-sectional schematic of the non-lethal variable distance electronic timed payload projectile ammunition 200 along line A-A of FIG. 5B pursuant to an embodiment of the present invention. FIGS. 6A, 6B, 6C, 6D, and 6E are perspective schematics respectively showing a conductive shell 260, a projectile body base 230*c*, a projectile body mid-section 230*b*, a projectile body nose 230*a*, and a blank load 270 pursuant to embodiments of the present invention.

More specifically and referring to FIGS. 4, 5A, 5B, 6A, 6B, 6C, 6D, and 6E, an embodiment of the present invention provides the non-lethal variable distance electronic timed payload projectile ammunition 200. The ammunition 200 includes the conductive shell 260, a non-lethal payload 210, a projectile body 230, a printed circuit board 255, an electronic igniter 250, a timing circuit (see, e.g., FIG. 1 or 2), a switch, and a battery. Here, the projectile body 230 is coupled to the conductive shell 260 and for carrying the non-lethal payload 210. The printed circuit board 255 is in the projectile body 230. The electronic igniter 250 is for initiating the non-lethal payload 210. The timing circuit is on the printed circuit board 255 and for electronically delaying ignition of the electronic igniter 250. The switch is for switching the timing circuit in and out of a dormant state and for varying ignition delay of the timing circuit 253 to ignite the electronic igniter, and the battery is for providing a first power to the timing circuit and a second power to the electronic igniter 250.

In one embodiment, the battery includes a first battery for providing the first power to the timing circuit, and a power capacitor separate from the first battery and for providing the second power to the electronic igniter 250.

In one embodiment, the timing circuit includes a microprocessor configured by the switch to select a projectile travel distance from a plurality of selectable projectile travel distances, the projectile body travel distance being controlled by the timing circuit and a velocity at which the projectile body 230 is traveling.

In one embodiment, the non-lethal variable distance electronic timed payload projectile ammunition 200 further includes a light emitting diode (LED) on the circuit board and for indicating that the timing circuit is out of the dormant state.

In one embodiment, the non-lethal variable distance electronic timed payload projectile ammunition 200 further includes a display on the circuit board and for indicating a state of the timing circuit.

Figure 7:
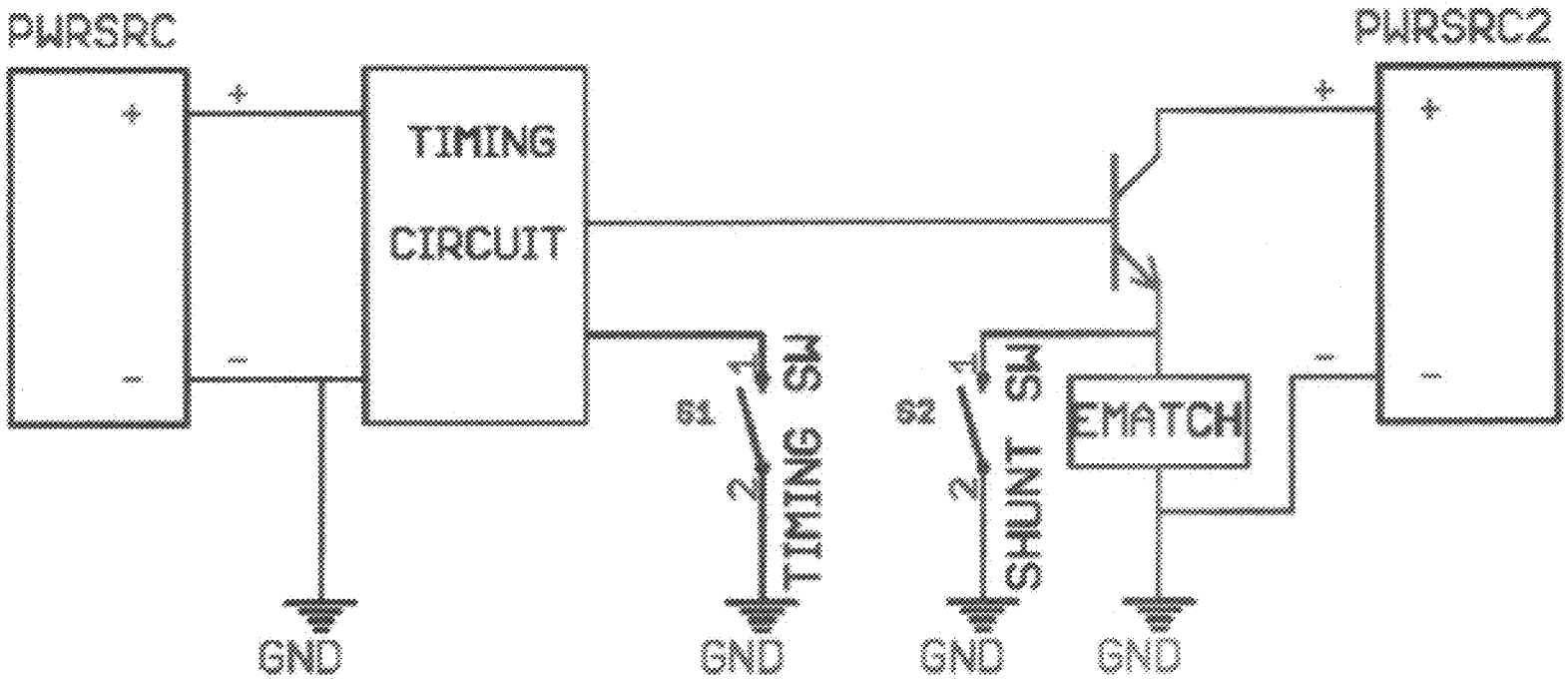
FIG. 7 is a partial block electrical schematic including a timing circuit that may be utilized in the non-lethal variable distance electronic timed payload projectile ammunition 200 pursuant to an embodiment of the present invention.

FIG. 7 is a partial block electrical schematic including a timing circuit that may be utilized in the non-lethal variable distance electronic timed payload projectile ammunition 200 pursuant to an embodiment of the present invention. Here, in one embodiment and referring now also to FIG. 7, the battery in the ammunition 200 includes a power source (PWRSRC)—e.g., a first battery—for providing the first power to the timing circuit, and a second source (PWRSRC2)—e.g., a second battery—separate from the first power source (PWRSRC) and for providing the second power to the electronic igniter 250 (EMATCH). Here, in one embodiment, the timing circuit is an RC timing circuit, Schmidt trigger, or 555 timing circuit.

In another embodiment, the second power source (PWRSRC2) is a power capacitor separate from the first power source (PWRSRC), which may be a battery, and the power capacitor may derive its power from a charge of the battery and/or another suitable power source.

In one embodiment, the non-lethal payload 210 is at the projectile body nose 230*a* and includes a chemical payload. Here, the chemical payload may be selected from the group consisting of chemical irritant powder payloads, chemical irritant liquid payloads, chemical marking powder payloads, chemical marking liquid payloads, chemical powder distraction payloads for producing between about 0 decibel (db) and about 300 decibel (db) when detonated, chemical powder flash payloads for producing flashes when detonated, ultra violet (UV) chemical powder payloads, UV chemical liquid payloads, infrared (IR) chemical liquid payloads, IR chemical powder payloads, and combinations thereof.

In one embodiment, the non-lethal variable distance electronic timed payload projectile ammunition 200 further includes the projectile body 230 that has projectile body base 230*c* with a boat tail for reducing base drag.

In one embodiment, the projectile body 230 has a driving band 290 to engage rifling of a launcher barrel to spin the projectile body for flight stability.

In one embodiment, the conductive shell 260 includes a blank cartridge (or blank load) 270 containing powder, and the blank cartridge 270 is configured to ignite the powder in the blank cartridge 270 when struck by a firing hammer of a launcher to separate the projectile body 230 from the conductive shell and to send the projectile body 270 out of the launcher.

In one embodiment, the non-lethal variable distance electronic timed payload projectile ammunition 200 further includes a potting filled at least partially around the timing circuit and on the printed circuit board 255 at the projectile body mid-section 230*b* to protect the timing circuit and the printed circuit board 255.

In one embodiment, the electronic igniter 250 is configured to be shunted until the ammunition 200 has been fired.

In one embodiment, the electronic igniter 250 is configured to be grounded to the conductive shell 260 to shunt and protect the electronic igniter 250 from being ignited until the projectile body 230 is separated from the conductive shell 260 even if power is provided to the electronic igniter 250.

In one embodiment, the electronic igniter 250 is configured to be grounded to the conductive shell 260 to shunt and protect the electronic igniter 250 from a radiated power capable of igniting the electronic igniter 250 and to pass the radiated power to ground.

In one embodiment of the present invention, the projectile body 230 carriers the non-lethal payload 210 at the projectile body nose 230*a* and is configured to be physically coupled to the conductive shell 260 until the ammunition 200 is fired. The electronic igniter 250 is configured to be electrically grounded to the conductive shell 260 until the projectile body 230 is separated from the conductive shell 260 and for initiating the non-lethal payload 210. The timing circuit is configured to be electrically grounded to the conductive shell 260 via a second ground until the projectile body 230 is separated from the conductive shell 260 and utilized for electronically delaying ignition of the electronic igniter 250. The switch is for switching the timing circuit in and out of a dormant state and for varying ignition delay of the timing circuit to ignite the electronic igniter 250. The primary power source is for providing a first power to the timing circuit to operate the timing circuit, and the secondary power source is for providing a second power to the electronic igniter 250 to ignite the electronic igniter 250.

Figure 8:
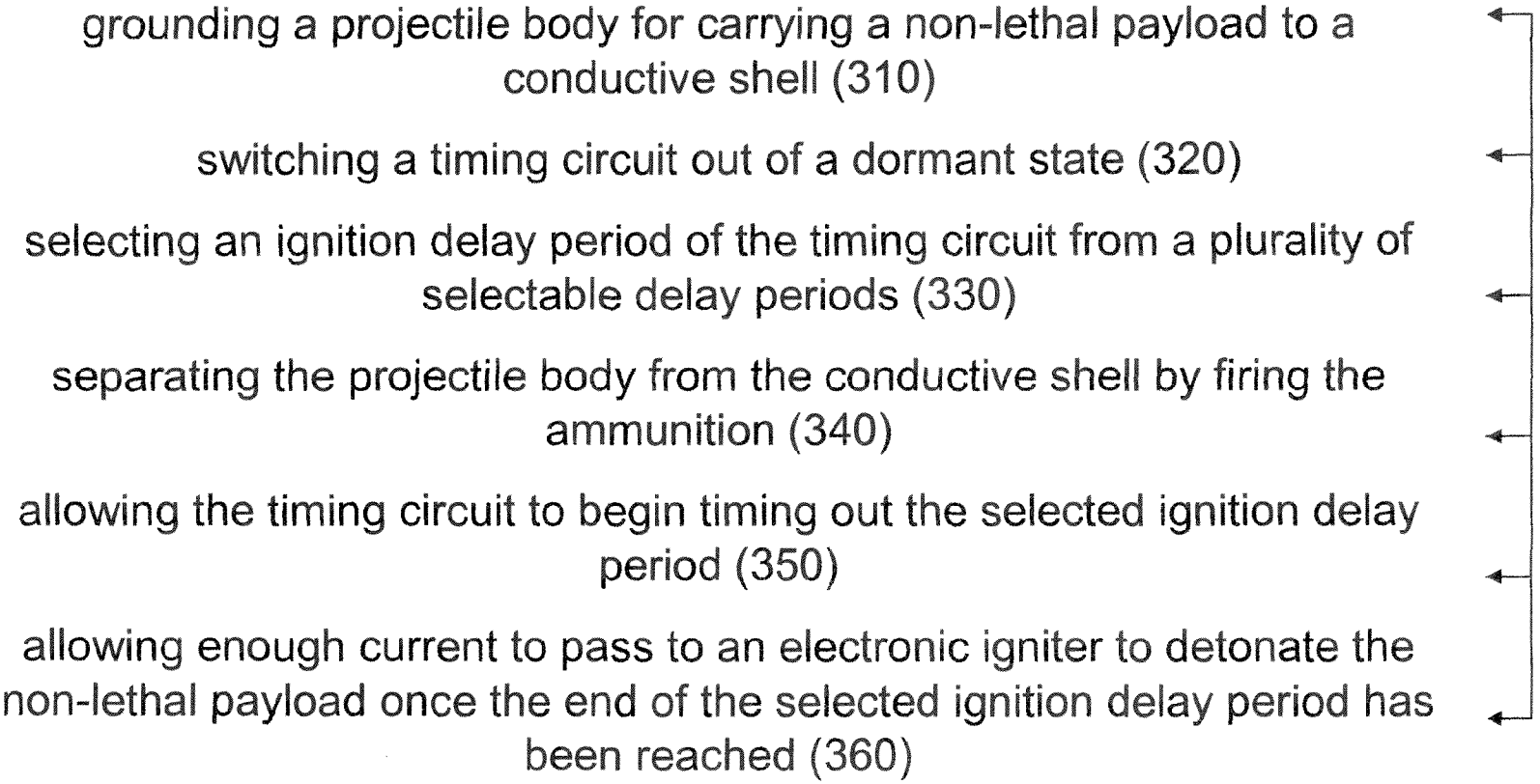
FIG. 8 is a process flow diagram on a method for varying an initiation time for a non-lethal variable distance electronic timed payload projectile ammunition pursuant to an embodiment of the present invention.

FIG. 8 is a process flow diagram on a method for varying an initiation time for a non-lethal variable distance electronic timed payload projectile ammunition pursuant to an embodiment of the present invention.

As illustrated in FIG. 8, a projectile body for carrying a non-lethal payload is grounded to a conductive shell in block 310. In block 320, a timing circuit is switched out of a dormant state. An ignition delay period of the timing circuit is then selected from a plurality of selectable delay periods in block 330. The projectile body is then separated from the conductive shell by firing the ammunition in block 340. The timing circuit is then allowed to begin timing out the selected ignition delay period in block 350. Then, in block 360, enough current is allowed to pass to an electronic igniter to initiate the non-lethal payload once the end of the selected ignition delay period has been reached.

Here, in the present method, the projectile body may have to be separated from the conductive shell before the time circuit can start timing and also before the electronic igniter can be ignited to initiate the non-lethal payload body.

In one embodiment, the grounding of the projectile body to the conductive shell in block 310 includes grounding the electronic igniter to the conductive shell, and the electronic igniter can not be ignited to initiate the non-lethal payload body until the grounding of the electronic igniter to the conductive shell has been severed.

In one embodiment, the allowing of the timing circuit to begin timing out the selected ignition delay period in block 350 includes severing the grounding of the projectile body from the conductive shell.

In one embodiment, the allowing of enough current to pass to the electronic igniter to initiate the non-lethal payload once the end of the selected ignition delay period has been reached in block 360 includes severing the grounding of the projectile body from the conductive shell.

In one embodiment, the allowing of the timing circuit to begin timing out the selected ignition delay period in block 350 includes providing a first power to the timing circuit to operate the timing circuit via a first battery, and the allowing of enough current to pass to the electronic igniter to initiate the non-lethal payload once the end of the selected ignition delay period has been reached in block 360 includes providing a second power to provide enough current to the electronic igniter to initiate the non-lethal payload via a secondary power source.

Figures 9A, 9B:
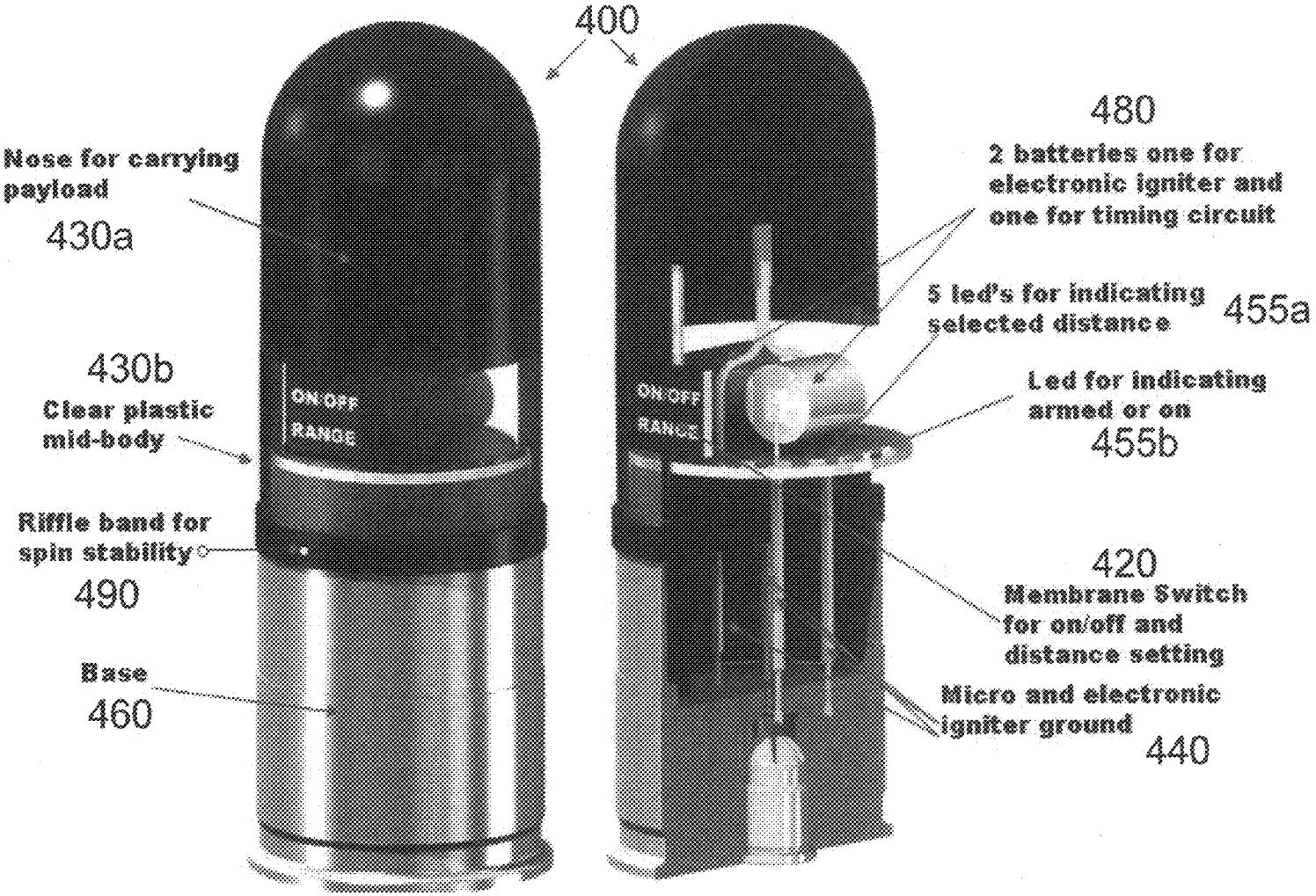
FIG. 9A is a perspective schematic of a non-lethal variable distance electronic timed payload ignition projectile ammunition pursuant to an embodiment of the present invention.
FIG. 9B is a cross-section schematic of the non-lethal variable distance electronic timed payload ignition projectile ammunition of FIG. 9A pursuant to an embodiment of the present invention.

FIG. 9A is a perspective schematic of a non-lethal variable distance electronic timed payload ignition projectile ammunition 400 pursuant to an embodiment of the present invention, and FIG. 9B is a cross-section schematic of the non-lethal variable distance electronic timed payload ignition projectile ammunition 400 of FIG. 9A pursuant to an embodiment of the present invention.

Referring to FIGS. 9A and 9B, the non-lethal variable distance electronic timed payload ignition projectile ammunition 400 includes a conductive shell 460, a non-lethal payload, a projectile body having a riffle band 490 for spin stability and including projectile body nose 430*a* for carrying the non-lethal payload and a projectile body mid-section (e.g., a clear plastic mid-body) 430*b*, a printed circuit board with a plurality of LEDs 455*a* for indicating selected distance and an LED 455*b* for indicating arming of the ammunition thereon, an electronic igniter, a timing circuit, a switch 420, and two batteries 480 one for powering the electronic igniter and one for the timing circuit. Here, the projectile body is coupled to the conductive shell 460 and for carrying the non-lethal payload. The printed circuit board is in the projectile body. The electronic igniter is for initiating the non-lethal payload. The timing circuit is on the printed circuit board and for electronically delaying ignition of the electronic igniter.

In one embodiment, the non-lethal variable distance electronic timed payload projectile ammunition 400 further includes electrical connectors and/or contacts 400 to block the timing circuit from its timing operation and/or the igniter from ignition. Specifically, in one embodiment, the electrical connectors and/or contacts 400 include a shunt connector connected to an electrical contact in the conductive shell 460 to block the timing circuit from its timing operation and/or the igniter from ignition.

It should be appreciated from the above that the various structures and functions described herein may be incorporated into a variety of apparatuses and implemented in a variety of ways. Different embodiments of the ammunitions and/or timing circuits may include a variety of hardware and software processing components. In some embodiments, hardware components such as processors, controllers, state machines and/or logic may be used to implement the described components or circuits. In some embodiments, code such as software or firmware executing on one or more processing devices may be used to implement one or more of the described operations or components.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. A non-lethal variable distance electronic timed payload projectile ammunition comprising:

a shell;

a non-lethal payload;

a projectile body coupled to the shell and for carrying the non-lethal payload;

a printed circuit board in the projectile body;

an electronic igniter for initiating the non-lethal payload;

a timing circuit on the printed circuit board and for electronically delaying ignition of the electronic igniter;

a switch for switching the timing circuit in and out of a dormant state and for varying ignition delay of the timing circuit to ignite the electronic igniter; and a battery for providing a first power to the timing circuit and a second power to the electronic igniter.

2. The non-lethal variable distance electronic timed payload projectile ammunition of claim 1, wherein the battery comprises:

a first battery for providing the first power to the timing circuit; and a second battery separate from the first battery and for providing the second power to the electronic igniter.

3. The non-lethal variable distance electronic timed payload projectile ammunition of claim 1, wherein the battery comprises:

a first battery for providing the first power to the timing circuit; and a power capacitor separate from the first battery and for providing the second power to the electronic igniter.

4. The non-lethal variable distance electronic timed payload projectile ammunition of claim 1, wherein the timing circuit comprises a microprocessor configured by the switch to select a projectile travel distance from a plurality of selectable projectile travel distances, the projectile body travel distance being controlled by the timing circuit and a velocity at which the projectile body is traveling.

5. The non-lethal variable distance electronic timed payload projectile ammunition of claim 1, further comprising a light emitting diode (LED) on the circuit board and for indicating that the timing circuit is out of the dormant state.

6. The non-lethal variable distance electronic timed payload projectile ammunition of claim 1, further comprising a display on the circuit board and for indicating a state of the timing circuit.

7. The non-lethal variable distance electronic timed payload projectile ammunition of claim 1, wherein the timing circuit is an RC timing circuit, Schmidt trigger, or 555 timing circuit.

8. The non-lethal variable distance electronic timed payload projectile ammunition of claim 1, wherein the non-lethal payload comprises a chemical payload.

9. The non-lethal variable distance electronic timed payload projectile ammunition of claim 8, wherein the chemical payload is selected from the group consisting of chemical irritant powder payloads, chemical irritant liquid payloads, chemical marking powder payloads, chemical marking liquid payloads, chemical powder distraction payloads for producing between about 0 decibel (db) and about 300 decibel (db) when detonated, chemical powder flash payloads for producing flashes when detonated, ultra violet (UV) chemical powder payloads, UV chemical liquid payloads, infrared (IR) chemical liquid payloads, IR chemical powder payloads, and combinations thereof.

10. The non-lethal variable distance electronic timed payload projectile ammunition of claim 1, further comprising a shunt connector connected to an electrical contact in the shell to block the timing circuit from its timing operation.

11. The non-lethal variable distance electronic timed payload projectile ammunition of claim 1, wherein the projectile body has a boat tail for reducing base drag.

12. The non-lethal variable distance electronic timed payload projectile ammunition of claim 1, wherein the projectile body has a driving band to engage rifling of a launcher barrel to spin the projectile body for flight stability.

13. The non-lethal variable distance electronic timed payload projectile ammunition of claim 1, wherein the shell comprises a blank cartridge containing powder, and wherein the blank cartridge is configured to ignite the powder in the blank cartridge when struck by a firing hammer of a launcher to separate the projectile body from the shell and to send the projectile body out of the launcher.

14. The non-lethal variable distance electronic timed payload projectile ammunition of claim 1, further comprising a potting filled at least partially around the timing circuit and on the printed circuit board to protect the timing circuit and the printed circuit board.

15. The non-lethal variable distance electronic timed payload projectile ammunition of claim 1, wherein the electronic igniter is configured to be shunted until the ammunition has been fired.

16. The non-lethal variable distance electronic timed payload projectile ammunition of claim 1, wherein the electronic igniter is configured to be grounded to the shell to shunt and protect the electronic igniter from being ignited until the projectile body is separated from the shell even if power is provided to the electronic igniter.

17. The non-lethal variable distance electronic timed payload projectile ammunition of claim 1, wherein the electronic igniter is configured to be grounded to the shell to shunt and protect the electronic igniter from a radiated power capable of igniting the electronic igniter and to pass the radiated power to ground.

18. The non-lethal variable distance electronic timed payload projectile ammunition of claim 1, wherein the shell is a conductive shell.

19. A non-lethal variable distance electronic timed payload projectile ammunition comprising:

a shell;

a non-lethal payload;

a projectile body for carrying the non-lethal payload and configured to be physically coupled to the shell until the ammunition is fired;

an electronic igniter configured to be electrically grounded to the shell until the projectile body is separated from the shell and for initiating the non-lethal payload;

a timing circuit configured to be electrically grounded to the shell via a second ground until the projectile body is separated from the shell and utilized for electronically delaying ignition of the electronic igniter;

a switch for switching the timing circuit in and out of a dormant state and for varying ignition delay of the timing circuit to ignite the electronic igniter;

a primary power source for providing a first power to the timing circuit to operate the timing circuit; and a secondary power source for providing a second power to the electronic igniter to ignite the electronic igniter.

20. The non-lethal variable distance electronic timed payload projectile ammunition of claim 19, wherein the shell is a conductive shell.

* * * * *